US006178663B1

(12) United States Patent
Schoesler

(10) Patent No.: US 6,178,663 B1
(45) Date of Patent: Jan. 30, 2001

(54) FLUID FILLED INSOLE WITH METATARSAL PAD

(76) Inventor: Henning R. Schoesler, c/o Familien Schoesler, Hoftrup Hovedgade 77, DK-6100 Haderslev (DK)

( * ) Notice: Under 35 U.S.C. 154(b), the term of this patent shall be extended for 0 days.

(21) Appl. No.: 09/264,446

(22) Filed: Mar. 8, 1999

Related U.S. Application Data

(63) Continuation-in-part of application No. 08/687,787, filed on Jul. 19, 1996, now Pat. No. 5,878,510, which is a continuation-in-part of application No. 08/047,685, filed on Apr. 15, 1993, now abandoned.

(51) Int. Cl.[7] ..... A43B 13/38
(52) U.S. Cl. ..... 36/43; 36/29; 36/88
(58) Field of Search ..... 36/28, 29, 43, 36/44, 71, 88, 93, 153

(56) References Cited

U.S. PATENT DOCUMENTS

| | | | |
|---|---|---|---|
| D. 246,486 | 11/1977 | Nickel . | |
| D. 255,060 | 5/1980 | Okazawa . | |
| 1,093,608 | 4/1914 | Delaney . | |
| 1,148,376 | 7/1915 | Gay . | |
| 1,193,608 | 8/1916 | Poulson . | |
| 1,304,915 | 5/1919 | Spinney . | |
| 1,781,715 | 11/1930 | Blakely . | |
| 2,080,469 | 5/1937 | Gilbert . | |
| 2,080,499 | 5/1937 | Nathansohn . | |
| 2,488,382 | 11/1949 | Davis . | |
| 2,502,774 | 4/1950 | Alianiello . | |
| 2,917,844 | 12/1959 | Scholl . | |
| 3,765,422 | 10/1973 | Smith . | |
| 3,795,994 | 3/1974 | Ava . | |
| 3,871,117 | 3/1975 | Richmond et al. . | |
| 3,892,077 * | 7/1975 | Wolstenholme et al. | 36/71 |
| 3,922,801 | 12/1975 | Zente . | |
| 3,990,457 | 11/1976 | Voorhees . | |

(List continued on next page.)

FOREIGN PATENT DOCUMENTS

| | | |
|---|---|---|
| 27666 | 12/1984 | (AU) . |
| 3629331A1 | 3/1988 | (DE) . |
| 1-126905 | 5/1989 | (JP) . |

* cited by examiner

*Primary Examiner*—M D Patterson

(57) ABSTRACT

A fluid filled insole comprises a fluid tight bladder having upper and lower layers and a generally foot-shaped, planar configuration, with proximal forefoot, midfoot and hindfoot regions; a heavy, viscous, sterile liquid substantially filling the bladder; at least one metatarsal pad in the proximal forefoot region of the bladder; flow passages between the metatarsal pad and the medial and lateral and peripheral margins of the bladder; a flow controller bridging the proximal forefoot and midfoot regions of the bladder and matched to the border between the lateral and medial longitudinal arch; and flow restrictors in the distal hindfoot defining a central longitudinal flow channel between the hindfoot and midfoot regions. The metatarsal pads and fluid flow are matched to the anatomical structure of the foot.

9 Claims, 3 Drawing Sheets

U.S. PATENT DOCUMENTS

| | | | | |
|---|---|---|---|---|
| 4,100,686 | | 7/1978 | Sgarlato et al. . | |
| 4,115,934 | * | 9/1978 | Hall | 36/29 |
| 4,123,855 | * | 11/1978 | Thedford | 36/29 |
| 4,183,156 | | 1/1980 | Rudy . | |
| 4,217,705 | | 8/1980 | Donzis . | |
| 4,219,945 | | 9/1980 | Rudy . | |
| 4,297,797 | | 11/1981 | Meyers . | |
| 4,336,661 | | 6/1982 | Medrano . | |
| 4,471,538 | | 9/1984 | Pomeranz . | |
| 4,472,890 | | 9/1984 | Gilbert . | |
| 4,567,677 | | 2/1986 | Zona . | |
| 4,571,853 | * | 2/1986 | Medrano | 36/43 |
| 4,590,689 | | 5/1986 | Rosenberg . | |
| 4,602,442 | | 7/1986 | Revill et al. . | |
| 4,799,319 | | 1/1989 | Zellweger . | |
| 4,845,861 | | 7/1989 | Moumdjian . | |
| 4,934,070 | | 6/1990 | Mauger . | |
| 4,934,072 | | 6/1990 | Fredericksen et al. . | |
| 4,991,317 | * | 2/1991 | Lakic | 36/43 |
| 5,067,255 | | 11/1991 | Hutcheson . | |
| 5,097,607 | | 3/1992 | Fredericksen . | |
| 5,203,793 | * | 4/1993 | Lyden | 36/93 |
| 5,313,717 | * | 5/1994 | Allen et al. | 36/29 |
| 5,406,719 | | 4/1995 | Potter . | |
| 5,878,510 | * | 3/1999 | Scholesler | 36/43 |

Fig. 3
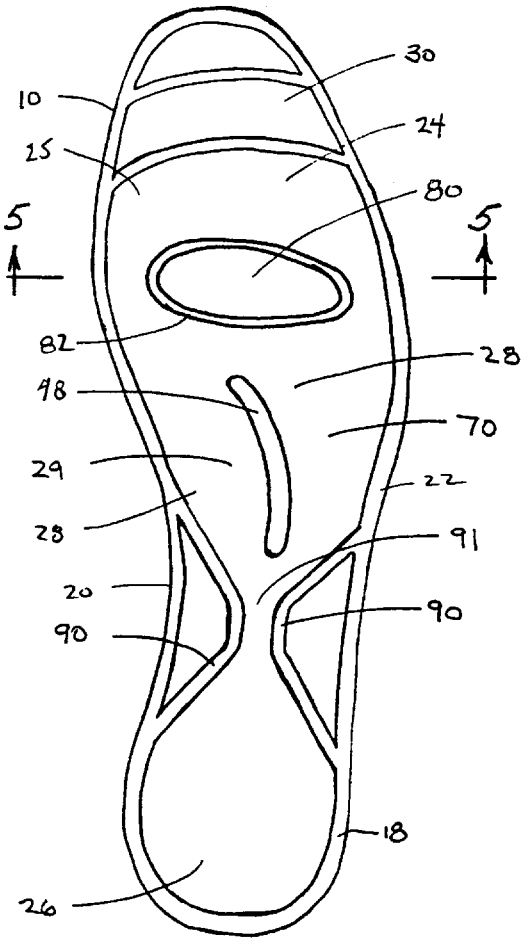
Fig. 4
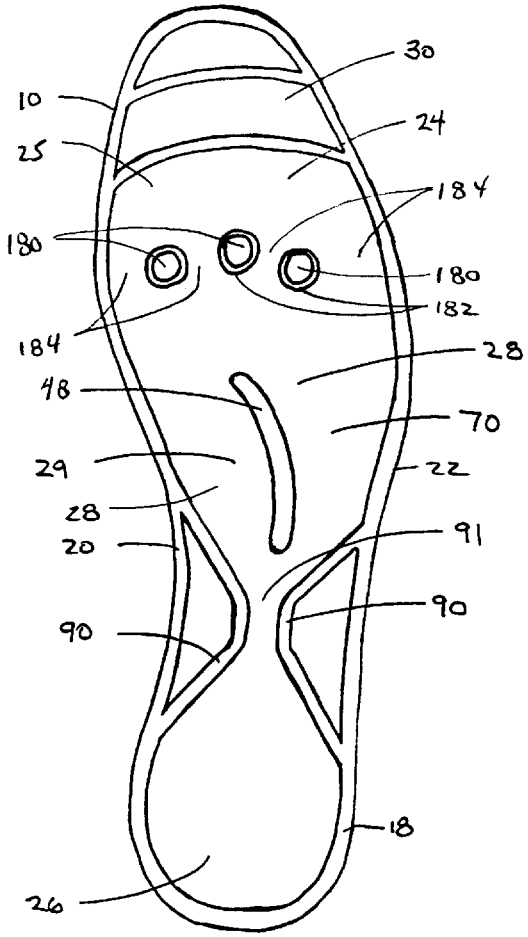
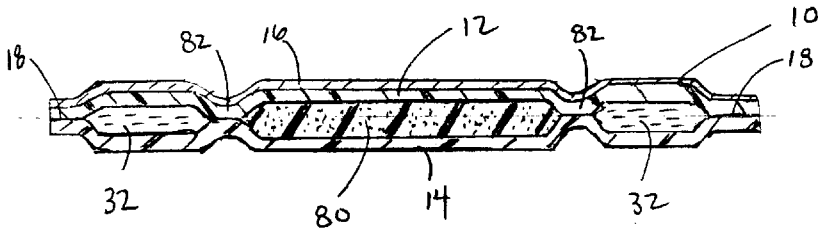
Fig. 5

FLUID FILLED INSOLE WITH METATARSAL PAD

CROSS REFERENCE

This application is a continuation-in-part of application Ser. No. 08/687,787 filed Jul. 19, 1996, now U.S. Pat. No. 5,878,510 which is a continuation-in-part of application Ser. No. 08/047,685 filed on Apr. 15, 1993, now abandoned.

BACKGROUND OF THE INVENTION

The present invention is directed to therapeutic fluid filled insoles, and more particularly to insole bladders having a pad or cushion in the forefoot region of the insole and having fluid controlling means in the midfoot and hindfoot regions. The purpose of the combination is to achieve improved medical benefits and directional stability to the users.

Fluid filled insoles have long been known in the art, see for example, U.S. Pat. No. 4,567,677 to James Zona, U.S. Pat. No. 4,115,934 to Hall, U.S. Pat. No. 4,123,855 to Thedford, U.S. Pat. No. 2,080,469 to Gilbert and U.S. Design Pat. No. D246,486 to John W. Nickel. Prior art insoles commonly comprise a bladder having an upper layer and a lower layer. The two layers are welded together at their marginal periphery. The bladder has a planar, foot-shaped configuration, which includes a forefoot region, a hindfoot region, and and a midfoot region there between. The bladder is filled with a fluid, such as water or air. The broader technical functions of fluid filled insoles are well documented, whereas the medical benefits are only marginally documented. It is not generally known that fluid filled insoles may be designed to accomplish specific medical benefits. Two significant limitations in the prior art are: (1) the flow of liquid/fluid is not matched to the anatomical structure of the foot, and (2) flow of fluid does not provide directional stability. The known technical functions include cushioning of the feet by a massaging action on the plantar surface of the feet due to movement of the fluid within the bladder, thus achieving comfort to the user.

The fluid filled insoles of the prior art have not been entirely satisfactory, however, in the area of providing demonstrative medical benefits, neither as a device for relieving fatigue in the lower extremities by providing pressure or stress distribution and activation of the venous pump function nor for achieving directional stability to the user when wearing the insole. Existing prior art insoles have little or no means for: (1) controlling both the transverse and longitudinal flow of fluid, (2) controlling the rate of fluid flow within the insole, or (3) matching the flow of fluid to the anatomical structure of the foot. As a user walks, the user's weight is initially applied to heel, and then is transferred to the ball of the foot. This causes the fluid within the bladder to move, respectively, from the hindfoot region to the forefoot region and then back towards the hindfoot again. Further, without means for directing fluid flow anatomically within the bladder, the fluid will flow uncontrollably and thus causing directional instability to the user when wearing the insole. Without means for controlling and restricting the rate of fluid flow vis-a-vis viscosity and density of the fluid, the foot will simply "jump through" the fluid in the insole when the wearer's weight is applied, and thus the fluid insole has little pressure distribution or massaging effect.

Some prior art devices, such as the insole of the Zona patent, have attempted to regulate flow from the hindfoot region to forefoot region and vice versa by placing flow restricting means in the midfoot area of the bladder. These flow restricting devices are only marginally effective, however, since they neither match the anatomical structure of the foot nor control the flow within the forefoot or hindfoot regions of the bladder to achieve directional stability and local pressure distribution. In addition, the midfoot flow restricting means are not matched to the anatomical structure of the longitudinal medial arch. Matching the anatomical structure of the foot to the location, direction, quantity and duration of fluid flow fully determine therapeutic benefits, pressure distribution and directional stability.

Some prior art insoles, as shown for example in the Hall or Nickel patents have attempted to regulate fluid flow within the forefoot and hindfoot regions. But, these efforts have not been satisfactory because the fluid flow is not matched to the anatomical structure of said local regions, but rather directed to the outer, medial and lateral, margins of the insole, away from the areas of the foot where fluid massaging action and pressure distribution is required when considering the physiology and anatomy of the foot.

The Thedford patent has also attempted to regulate fluid flow within the forefoot and hindfoot regions. These teachings have not been anatomically satisfactory because the fluid flow is neither adapted to the anatomical structure of the foot nor arranged in a fashion that achieves directional stability to the user during the flow of fluid within the insole. Further, the Thedford patent teaches prohibition or blocking of longitudinal flow within the bladder, redirecting the flow in a transverse direction.

The Gilbert patent has attempted to regulate fluid flow by randomly dispersing flow restrictors across the entire surface of the insole, which, again, does neither match the anatomical structure of the foot nor achieve directional stability. The Gilbert patent does not specify any particular arrangement of flow restrictors or fluid flow, but teaches that the "spots" "may be disposed at any desirable location with any desirable frequency" which makes flow control indefinite. Further, the Gilbert patent permits air to shift in any direction and partly arranges flow restricting means to block longitudinal flow.

Many prior art insoles are filled with ordinary water or other fluids that not only quickly evaporate and thus significantly reduce the industrial applicability (life time) of the insole, but also develops bacteria and/or other microorganisms, causing the fluid to become toxic and thus environmentally unsafe. In addition, existing prior art insoles do not consider the fluid itself as a flow restricting means and thus significantly limits the therapeutic value of the insole by allowing the fluid to flow at a rate that cannot satisfactorily provide pressure distribution. The rate of fluid flow significantly influences pressure distribution.

None of the prior art insoles considers local pressure distribution within each of the midfoot, forefoot and hindfoot regions of the bladder by directing and anatomically controlling the flow of fluid within each of the midfoot, forefoot and hindfoot regions.

Finally, none of the prior art insoles considers combining (i) fluid flow in the hindfoot and midfoot regions with (ii) pads or cushions in the forefoot region with the purpose of diffusing forefoot discomfort and relieving pain at localized areas. These lacking considerations significantly limit the medical and therapeutic applications of the prior art insoles. It would be desirable to have a fluid filled insole that (i) controls and directs the fluid to match the anatomical structure of the foot and achieves directional stability to the user wearing the insole, (ii) maximizes pressure distribution to minimize peak pressures on the foot, both across the entire area of the foot and within each of the hindfoot, midfoot and forefoot regions, (iii) ensures minimum evaporation of the fluid to maximize the life time of the insole, (iv) provides a fluid that is environmentally safe, (v) devises a fluid that functions as a flow restricting means vis-a-vis the density and viscosity of the fluid to enable maximum pressure distribution, and (vi) combines (i) to (v) with pads or cushions in the forefoot region to achieve support and relieve pain at localized areas, which otherwise overcomes the limitations inherent in the prior art

OBJECTS OF THE INVENTION

It is an object of the invention to provide an insole that has a superior therapeutic fatigue-relieving effect by providing maximum pressure distribution in each of the hindfoot, midfoot and forefoot areas of the plantar surface of the user's foot, while improving the muscular venous pump function by means of the flow of fluid interacting with foot movements.

It is a further object of the invention to provide a fluid filled insole wherein the fluid flow matches the anatomical structure of functionally normal feet; the fluid being directed and controlled in transverse and longitudinal flow passages that are adapted to the anatomical structure of functionally normal feet, thereby achieving directional stability for the user when wearing the insole.

It is another object of the invention to provide a liquid filled insole that increases the weight bearing surface area of the user's foot by improving the distribution of the user's weight both over the total area of the foot and within each of the hindfoot, midfoot and forefoot regions, thereby reducing peak pressures on the plantar surface of the user's foot.

It is a fourth object of the invention to provide an insole filled with a sterile, non-toxic, non-greasy fluid that not only has low evaporation rates but also remains environmentally safe during the entire life time of the insole.

It is a fifth object of the invention to provide a liquid filled insole that is durable and not prone to lose fluid by leakage, evaporation or diffusion, thus prolonging the life time of the insole.

It is a sixth object of the invention to provide a fluid filled insole that increases the weight bearing surface within each of the forefoot, midfoot and hindfoot regions by (i) restricting the flow of liquid between the three regions and by (ii) directing and controlling the liquid within each of the regions (local pressure distribution).

It is a seventh object of the invention to provide a fluid filled insole that enables pain and discomfort relief within localized areas of the forefoot region by providing pads or cushions in said region.

SUMMARY OF THE INVENTION

The insole of the invention comprises a fluid tight bladder having an upper layer of flexible material and a lower layer of flexible material sealingly joined together at their peripheral margins. The bladder has a generally foot shaped planar configuration, with a proximal forefoot region, a hindfoot region, and a midfoot region there between. The bladder is filled with a large molecular, non-evaporable, highly viscous, sterile liquid, preferably a mixture of hygroscopic, polyvalent alcohol and distilled water. Within the proximal forefoot region of the bladder is positioned, at least one metatarsal pad preferably proximal to one or more of the wearer's metatarsal heads. A barrier is placed around the pad to prevent the pad(s) from being saturated with liquid. Preferably, at least a portion of the pad underlies the wearer's first metatarsal head. The metatarsal pad(s) comprise a cushioning foam material or a non-flowable, semi-solid fluid or gel, as opposed to a flowable liquid bladder.

More specifically, a first embodiment comprises a single, relatively large pad that substantially underlies the area proximal to all five metatarsal heads of a normal foot. The shape of the metatarsal pad is preferably oval or elliptical, but alternative shapes may be used.

A second embodiment of the invention is characterized by plural (two to six) metatarsal pad flow deflectors preferably placed substantially proximal to one or more of the metatarsal heads in the proximal forefoot region. Preferably, at least one of the pads underlies the first metal head. A metatarsal pad flow deflector placed just proximal to one of the meal heads elevates the heads and will result mechanically in decreased extension of the metatarsophalangeal joints.

It is desirable, but not necessary, that the metatarsal pads are substantially equally spaced transversely one from the other, and spaced from the medial and lateral margins of the bladder. Substantially equally sized longitudinal flow channels may thus be formed between the flow deflectors and between the flow deflectors and medial and lateral margins of the bladder.

Bridging the proximal forefoot region and the midfoot region of the bladder is a flow controller, which is generally anatomically matched to the structure of the longitudinal arches of a normal foot. The arch flow controller comprises an elongated, semicircular shaped weld, between the upper and lower bladder layers. The longitudinal arch flow controller and the medial peripheral margin of the bladder define a semi-enclosed volume. In use, a liquid pad or pillow is formed that substantially underlies the anatomical structure of the medial longitudinal arch region of a normal foot.

The insole of the invention preferably further comprises a pair of flow restrictors at the distal end of the hindfoot region, one on the lateral margin of the bladder and the other on the medial margin. The pair of hindfoot restrictors form a longitudinal flow channel there between. The proximal hindfoot region is preferably free of flow deflectors or the like.

A third embodiment is similar to the first, but is provided with between one and five hindfoot flow deflectors. Substantially equal sized, longitudinal hindfoot flow passages are created between the hindfoot deflectors, as disclosed in my U.S. Pat. No. 5,878,510 issued Mar. 9, 1999, which is hereby incorporated by reference.

A fourth embodiment is similar to the second, but is provided with a pair of flow restrictors against the lateral and medial margins in the proximal end of the proximal forefoot region of the bladder. A longitudinal flow channel is created between the restrictors, as disclosed in my U.S. Pat. No. 5,878,510.

The majority of the bladder is filled with a large molecular, non-evaporable, highly viscous, sterile liquid, preferably a mixture of hygroscopic, polyvalent alcohol and distilled water. The distal forefoot region and the metatarsal pads are preferably free of liquid. The liquid has a viscosity and density of at least 1.10 times that of ordinary water. I refer to this as a "heavy liquid." For the above reasons, the density of the fluid, measured by g/m3, is higher than the density of water (density=weight), because a higher weight of the fluid (compared to water) restricts the rate of fluid flow. For the same reasons, the thickness (viscosity) is also higher than that of water, because a higher thickness of the fluid (compared to water) restricts the rate of fluid flow. This mixture is sterile, non-toxic and resistant to contamination by bacteria or other microorganisms, thereby ensuring an environmentally safe fluid within the insole. Further, the mixture of hygroscopic, polyvalent alcohol and distilled water is not susceptible to evaporation or diffusion through the bladder layers. It is also autoclavable. In the event of a bladder puncture, the liquid may be easily removed from clothing and footwear, as the mixture is also relatively non-greasy.

The insole of the invention provides several desirable medical benefits. The insole relieves fatigue during prolonged standing or walking by distributing the user's weight anatomically over the area of the foot. The weight bearing surface area of the wearer's feet is increased, thereby reducing peak pressures exerted on the plantar surface of the user's foot and resulting deformation of soft tissue. The reduction in pressure thereby further relieves stress on the bones of the foot that can cause foot pain, hard skin and in extreme situations, ulceration.

Second, the anatomically controlled flow of fluid through the bladder across the plantar surface of the user's feet provides a therapeutic movement of the small intrinsic muscles of the feet. The movement of the muscles animates the venous pump function increasing blood circulation, which in turn improves transport of oxygen and nutrients to the cells in the foot and removal of waste products excreted from the cells.

Third, the fluid flow and the specific location of the metatarsal pads is matched to the anatomical structure of the foot and thus aid in anatomically correct locomotion. This in turn provides not only directional stability when the fluid moves within the insole, but also alleviates the foot abnormalities over supination and over pronation found in asymmetric feet.

Fourth, the metatarsal pads enable specific discomfort and pain relief at localized areas in the forefoot region by their location just proximal to and around the painful areas.

Other attributes and benefits of the present invention will become apparent from the following detailed specification when read in conjunction with the accompanying drawings.

BRIEF DESCRIPTION OF THE DRAWINGS

FIG. 3 is a plan view of a first embodiment of the invention.

FIG. 4 is a plan view of a second embodiment of the invention.

FIG. 5 is a cross-sectional view of the first embodiment of the invention taken along line 5—5 of FIG. 3.

DETAILED DESCRIPTION

Figure 1:
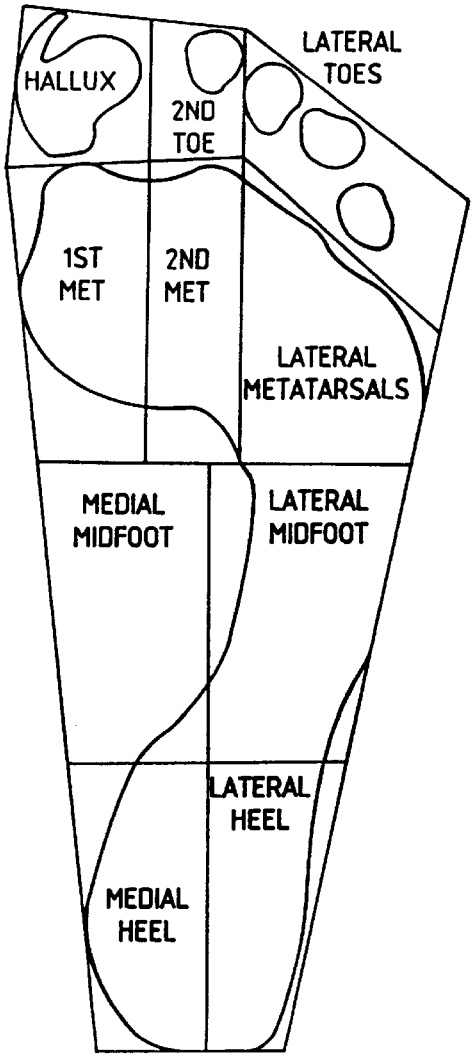
FIG. 1 is a plan view of the human foot illustrating the medial and lateral portions thereof, and the weight bearing area of a typical, functionally normal foot.
Figure 2:
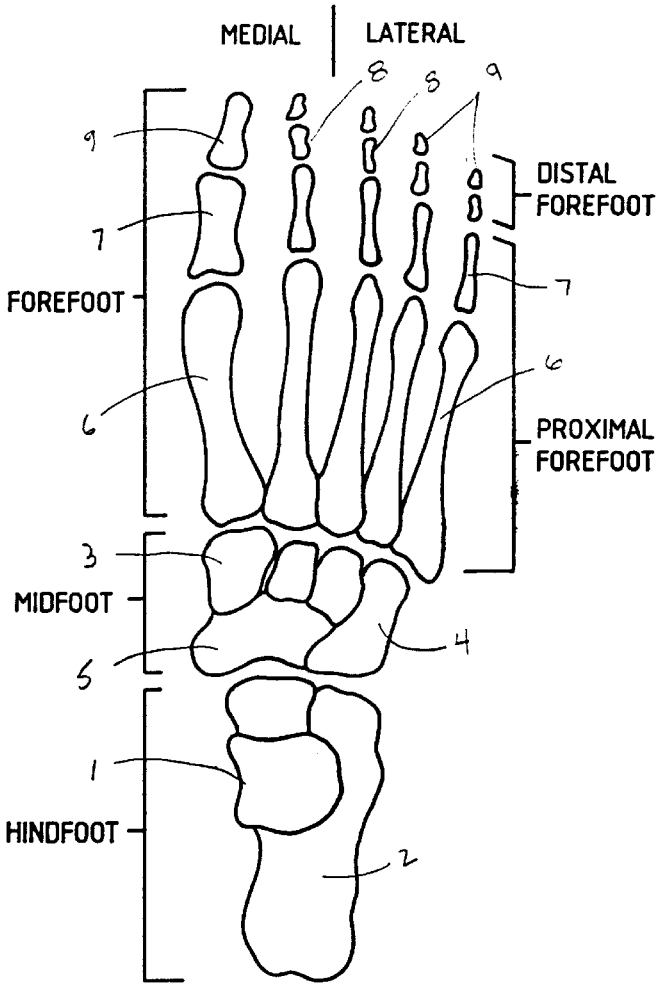
FIG. 2 is a dorsal view of the bones of the human foot.

Turning now to the drawings, FIGS. 1 and 2 illustrate the structure of the human foot The foot comprises a (i) hindfoot region containing the talus 1 and os calcis 2 bones; (ii) a midfoot region containing the cuneiform 3, cuboid 4 and navicular 5 bones; and the forefoot region comprising the matatarsals 6, the proximal phalanges 7, and the middle 8 and distal 9 phalanges. The forefoot region can be divided into two sub-regions, the distal sub-region comprising the middle and distal phalanges, and the proximal forefoot region which comprises the metatarsal and proximal phalanges. The foot also includes a longitudinal arch, having a medial and a lateral side. The medial longitudinal arch is defined by the navicular and medial cuneiform bones of the midfoot and the about the proximal half of the first, second and third metatarsals. The typical weight bearing area of a functionally normal foot appears from FIG. 1. The weight is not equally distributed over the plantar area of the foot.

In FIGS. 3 and 5, a first embodiment of the fluid filled insole of the invention is shown. The insole comprises a bladder 10 having an upper layer 12 and a lower layer 14. The insole preferably further includes a layer of textile or a sweat absorbing material 16 substantially covering and laminated to the outer surface of upper layer 12. Optionally a textile layer could be added to the bottom surface of the insole. The bladder layers 12 and 14 are sealing joined at their peripheral margins 18. For reference, the medial peripheral margin is numbered 20 and the lateral peripheral margin is numbered 22. The bladder comprises three main regions, namely a forefoot region 25, a hindfoot region 26 and a midfoot region 28 there between. The forefoot region is divided into a distal subregion 30 and a proximal forefoot region 24.

The interior cavity 32 of the bladder 10 is filled with a sterile, non-toxic, non-evaporable fluid with a density and viscosity of at least 1.10 times that of water. The fluid is preferably a "heavy liquid" mixture of large molecular, hygroscopic polyvalent alcohol and distilled water, as is more fully described below. The fluid may flow between and throughout the proximal forefoot, midfoot and hindfoot regions. The distal forefoot subregion 30 preferably does not contain fluid.

Within the proximal forefoot region 24 of bladder 22 there is a metatarsal pad 80 substantially proximal to the wearer's metatarsal heads. A barrier 82 is placed around the pad to prevent the pad from being saturated with liquid. Preferably, at least a portion of the pad underlies the wearer's first metatarsal head. The pad 80 need not cover the entire area of the forefoot region. The metatarsal pad comprises a cushioning foam material or a non-flowable, semi-solid fluid or gel, as opposed to a flowable liquid bladder. More specifically, a first embodiment comprises a single, relatively large pad that substantially underlies the area proximal to the five metatarsal heads in the forefoot region. The shape of the metatarsal pad is preferably oval or elliptical, but alternative shapes may be used.

FIG. 4 shows a second embodiment of the invention is characterized by plural (two to six) metatarsal pad flow deflectorsl80 preferably placed substantially proximal to one or more of the five metatarsal heads in the proximal forefoot region. Preferably, at least one of the pads 180 underlies the first metatarsal head. A metatarsal pad flow deflector placed just proximal to one of the metatarsal heads elevates the heads and will result mechanically in decreased extension of the metatarsophalangeal joints. The metatarsal pads 180 are substantially equally spaced transversely from the imaginary longitudinal centerline of each other, and spaced from the medial and lateral margins of the bladder. In both the first and second embodiments, substantially equally dimensioned longitudinal flow channels are formed between the flow deflectors and between the flow deflectors and medial and lateral margins of the bladder.

The metatarsal pads 180 are arranged in a shape that laterally, medially, transversely and longitudinally matches the anatomical structure of the proximal forefoot region, the shape being for example, but not limited to, an arc, a semicircle, or a trapezoid, the convex side of the shape facing in a distal direction. The arrangement and spacing between pads may desirably be made in the same manner as the forefoot flow deflectors disclosed in my U.S. Pat. No. 5,878,510.

The metatarsal pads 80,180 are formed by welding the upper bladder layer 12 to the lower bladder layer 14 circumferentially around the pads 80,180 to form a barrier 82,182. Metatarsal pads 80,180 are shown as being oval or circular, but other shapes may be alternatively used.

Bridging the proximal forefoot region and the midfoot region 28 of bladder 10 is a flow controller 48, which is generally matched to the wearer's arch. The arch flow controller may be configured in several different ways, but must match the contour or anatomical structure of the longitudinal arches of a normal foot, as described above in reference to FIGS. 1 and 2. The lateral edge of the longitudinal medial arch is generally an elongated, semicircular line substantially at the longitudinal border of the lateral and medial arch of a normal foot, such as shown in FIG. 1. The longitudinal medial arch extends from the proximal part of the midfoot area to about the mid-point of the metatarsals, as shown in FIG. 1. Flow controller 48 is shaped and located to match at least a portion of the border between the medial and lateral longitudinal arch. A midfoot flow channel 70 is formed on the lateral side of controller 48. A semi-enclosed area or volume 29 is defined by the longitudinal arch flow controller 48 and the medial peripheral margin of the bladder that substantially matches at least a portion of the anatomical structure of the medial longitudinal arch region of a normal foot. In this way, liquid will flow from the proximal forefoot region and into the medial arch region, thus substantially forming a liquid pad or pillow under at least a portion of the area of the medial arch.

In the hindfoot region, there are flow restricting features in the distal part of the hindfoot region that regulate the flow of fluid into and out of the hindfoot region. Specifically, a pair of flow restrictors 90 are located adjacent to the lateral and medial peripheral margins, respectively, in the distal end of the hindfoot region, roughly at the border between the hindfoot and midfoot regions. This pair of hindfoot flow restrictors defines a longitudinal channel 91 there between, the channel 91 having a transverse width of between 10 and 30 percent of the maximum straight transverse width of the hindfoot region of the bladder.

Figure 6:
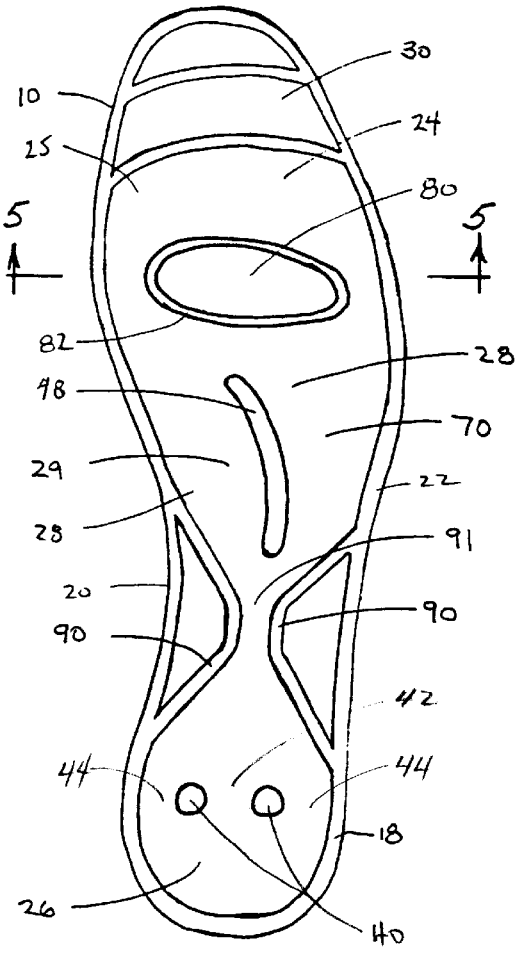
FIG. 6 is a plan view of a third embodiment of the invention.

FIG. 6 illustrates a third embodiment of the invention, which is similar to the first embodiment. The third embodiment is provided with between one and five, preferably two, hindfoot flow deflectors 40. Substantially equal sized, longitudinal hindfoot flow passages 42,44 are formed between the hindfoot deflectors and between the lateral and medial margins of the bladder as disclosed in my U.S. Pat. No. 5,878,510. However, it should be appreciated the such hindfoot flow deflectors are optional and are not strictly required.

Figure 7:
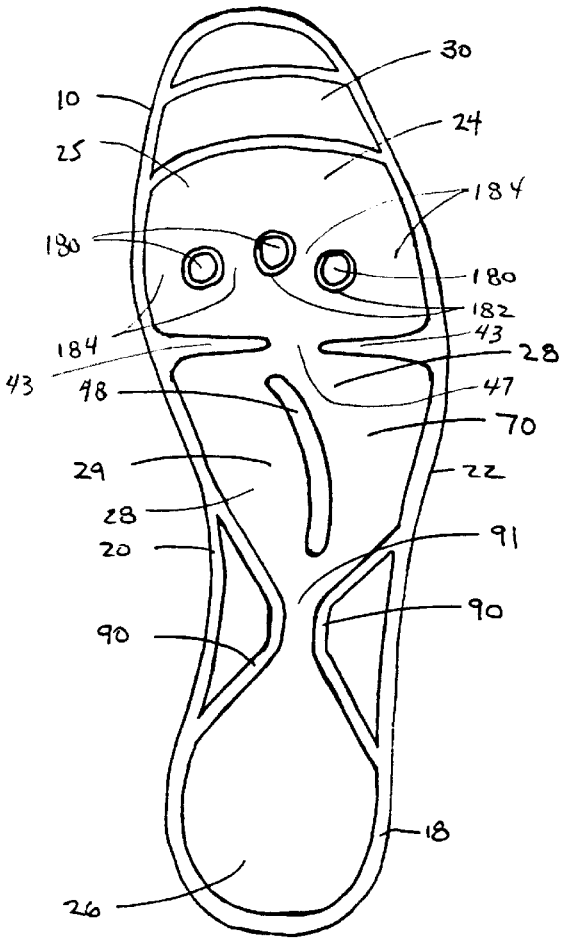
FIG. 7 is a plan view of a fourth embodiment of the invention.

FIG. 7 illustrates a fourth embodiment, which is similar to the second embodiment. The fourth embodiment is provided with a pair of flow restrictors 43 against the lateral and medial margins in the proximal end of the proximal forefoot region of the bladder. A longitudinal flow channel 47 is created between the restrictors, as disclosed in my U.S. Pat. No. 5,878,510.

The bladder is preferably fabricated from polyurethane film although other thermoplastic materials, such as EVA, PVC or vinyl may also be used. The thickness of each bladder layer should be from about 300 to 800 micrometers, 400 micrometers being preferred. The sweat absorbing material is preferably about 250 micrometers in thickness. Other textile materials may be used for comfort or breathability regardless of sweat absorbing properties. The bladder may be formed by conventional radio frequency or dielectric welding techniques. Other welding techniques, such as thermal welding may be used alternatively. The bladder is filled with the liquid mixture leaving an opening in the peripheral weld, through which liquid may be introduced, then sealing the opening. The insole of the invention may be made and sold as an insole for removable placement in shoes by the user. Also, the insole may be built into footwear as a permanent feature.

The fluid used to fill the cavity 32 of the bladder 10 is preferably a mixture of distilled water and a sterile, non-toxic, non-evaporable, large molecular, hygroscopic liquid to prevent evaporation or diffusion through the bladder. Polyvalent alcohols with large molecules and with non-toxic properties are preferred. One suitable formulation comprises approximately 85–98%, hygroscopic polyvalent alcohol and approximately 2–15% distilled water. By using this mixture in lieu of plain water, improved benefits are achieved: The mixture of the invention as compared to water does not evaporate or diffuse through the bladder layers, thereby significantly improving life time and durability of the insole. The liquid can withstand autoclaving as may be required by health care institutions. The insoles can be used in temperature ranges from minus 20 degrees Celsius to plus 120 degrees Celsius, because both the liquid mixture and bladder materials can withstand these temperature extremes. The liquid is fully sterile and non-toxic, and thus environmentally safe.

The sterility and/or non toxicness of the fluid is extremely important for several reasons. Children, people and animals could bite the insole, possibly drinking or swallowing the liquid. Water becomes septic after a few months of storage within insoles, because bacteria will grow and flourish in the water.

Compared to water, the mixture of polyvalent alcohol and distilled water has a significantly higher density and viscosity. The fluid of the invention has a preferred density and viscosity range of at least 1.10 times that of water. The actual filling of fluid with a particular density that is at least 1.10 times that of water depends on the flow controlling means within the bladder. Generally, the more the flow of liquid within the bladder is restricted by flow controlling means in the forefoot, midfoot and hindfoot regions, the lower the requirement for the density and viscosity of the liquid. Inversely, the fewer flow controlling means within the bladder, the higher the density and viscosity required. The density and viscosity of the fluid causes an improvement in the effects on the user's foot when wearing the insoles, because the density and viscosity generally controls the rate of flow of the viscous liquid within the insole. In this way, the density and viscosity strongly influence not only the degree of pressure distribution with following reduction of peak pressures on the plantar surface of the foot, but also directional stability.

The liquid used is a thick or heavy liquid that is resistant to flow, but not so thick that flow is unduly restricted. It is intended that when body weight is applied to one area of the bladder, the fluid will slowly and gradually flow out of the area after application of load over a few milli-seconds of time, thus the fluid is functioning as a flow restricting means and thereby enable an improved weight pressure distribution as compared to the fluid being ordinary water. Preferably, the fluid does not leave a region before the weight load is applied to that region. Referring to FIG. 3 as an example, when a user places his/her heel to the hindfoot region the fluid will not immediately leave the region, i.e., the fluid will not "jump" out of that area upon application of load. Rather, the fluid will not flow out of the hindfoot region before application of weight load has occurred. I refer to this as a "heavy liquid. " For the above reasons, the density of said fluid, measured by g/m3, is higher than the density of water (density=weight), because a higher weight of the fluid (compared to water) restricts the rate of flow of fluid. For same reasons, the thickness (viscosity) is also higher than water, because a higher thickness of the fluid (compared to water) restricts the flow of fluid, and thus enable application of weight load before the fluid leaves a region.

The liquid is relatively non-greasy. Thus, if the insoles are punctured or for any reason the liquid runs out into the user's socks or shoes, the shoes and socks may be readily cleaned.

Testing has shown that there are five basic beneficial effects from wearing the insoles of the invention, namely: (1) reducing pressure on the foot; (2) improves the venous pump function by causing a movement of all the small intrinsic foot muscles; (3) symmetric walking, (4) directional stability, and (5) pain relief at localized areas in the forefoot region by means of placing pads or cushions just proximal to and around the painful area. Each of these therapeutic benefits will be explained in turn.

In the body, blood is pumped from the heart through the arteries out to the energy consuming muscles, where the blood carries the various energy substances such as carbohydrates and oxygen. Within the muscles, the energy is subsequently provided by an oxidation process in which carbohydrates interact with oxygen creating carbon dioxide, water and energy. If a person is working extremely hard—resulting in substantial use of muscles—the oxygen supplied to the muscles (through the blood supply) is insufficient to supply the muscles with sufficient energy. Energy may also be produced in the muscles by splitting of glycogen into lactic acid and energy. Glycogen is a substance in the muscles. The oxygen-poor blood and cell waste products that have resulted from the energy production will then be transported through the veins back to the heart and the purifying organs of the body. The veins function with the muscles to form a venous pump system that eases the transport of the blood back to the heart. The venous pump functions in cooperation with the muscle activity since the moving muscles cause the veins to stretch and contract. Since the veins internally are equipped with valves (flaps) that prevent the blood from flowing away from the heart, the muscle activity on the veins causes the veins to function as a pump system that significantly increases blood transportation back to the heart.

When an individual is standing or walking for more than four hours per day, the foot muscles may receive insufficient movement and exercise. Individual movement of the many small muscles in the foot is hindered. If the foot muscles have insufficient strength, they do not have the sustaining strength to maintain the weight of the body, and the heel bone and metatarsal bones may sink downwardly. The following chain reaction occurs:

1. When the feet collapse ("sink down"), the foot muscles are compressed, which reduces blood flow. Simultaneously, low muscle activity from the compression of the foot muscles causes a reduction of the venous pump function.
2. The foot muscles do not receive sufficient oxygen and carbohydrate quantities for maintaining adequate energy production and oxidation.
3. Because of the constant pressure and lack of supply of oxygen and carbohydrates, the foot muscles start to produce energy by splitting of glycogen to lactic acid and energy.
4. Because blood circulation is hindered, the process will accumulate lactic acid in the foot muscles.
5. Lactic acid causes fatigue, heavy legs, and later pain, depending on the length of time walking or standing.
6. The fatigue feeling tends to cause people to place themselves in inappropriate or awkward positions in an effort to remedy the feeling, again affecting other muscles, leading to pain in legs, back, head, etc.

With the insole of the invention, the movement of the liquid within the bladder will result in the user's body weight being more widely distributed over the area of the foot, thereby increasing the weight bearing surface area of the foot, and relieving peak pressures on the foot muscles. Again, the weight is not equally distributed on/over the plantar surface area of a normal foot, see FIG. 1. Further, the simultaneous movement of fluid within the bladder causes the small intrinsic foot muscles to move, which, combined with the pressure distribution effect, improves the venous pump function and thus avoiding the above chain reaction. Tests reveal that the insole of the invention reduces peak pressures, measured by the average pressure in kilograms per square centimeter against the plantar surface of the user's foot. The improved distribution of the user's weight is particularly applicable during standing or walking. It is important to avoid high pressure on heel and metatarsal bones, since such pressure can cause foot pain, hard skin, and, in extreme situations, ulceration. These abnormalities are well known in diabetic feet.

The weight of the user pressurizes the liquid within the bladder. The pressurized liquid will constantly move the non-loaded parts of the bladder upwards. Movement or weight shift by the user will cause fluid movement, whereby a constant movement of the small internal foot muscles occurs. A considerably improved venous pump function is thereby established in the foot itself. A constant massage of the foot sole occurs for each time weight distribution is changed by the movement of the fluid within the three regions. When the feet, and thus the weight, is placed on the insoles, a weight pressure redistribution action takes place between the feet and the insoles, stimulating the blood veins. The effect is a considerably improved venous pump function, which is obviously very important for any person participating in a standing, walking or running activity. The function of the blood is to transport oxygen and nutrients to the cells, and return waste products to be excreted from the user's kidneys, through the urine. Improved blood circulation will decrease the amount of lactic acid, an element known as causing fatigue or myasthenia. Blood circulation is thus very important to individuals applying their muscles extensively, since muscle exertion constrains the blood corpuscles, thus hampering the transport of nutrients and waste products. Another effect of insufficient blood supply is a reduction of the contraction ability of the muscles. The fluid filled insole of the invention enhances the location, degree and duration of beneficial pressure distribution as compared to the prior art vis-a-vis the flow of fluid that is specifically matched to the anatomical structure of the foot (FIGS. 1-B and 1-C). A positive effect is a reduction and in many instances elimination of the painful effect of soreness in feet, legs, and back caused by prolonged standing or walking. The features that distinguish the current invention from the prior art is further the specific location of the flow deflectors and restrictors in the forefoot, midfoot and hindfoot regions, enabling a flow of fluid matched to the anatomical structure of the feet. The flow deflectors and restrictors and their following flow passages ensure directional stability during locomotion by enabling a controlled circulation of liquid that is matched to the anatomical structure of the normal foot. This is important since uncontrolled liquid circulation would result in unstable walking, unstable weight distribution, discomfort, and potentially the development of foot abnormalities. Directional stability, as achieved by the designed liquid circulation of the invention and as distinguishable over the prior art, ensures an anatomical locomotion pattern for the wearer, because the weight is anatomically distributed on the foot. The insole can alleviate the problems involved in over-supination and over-pronation, i.e., where the user's feet are turning abnormally either to the medial, inner side or the lateral, outer side of the foot ("asymmetric feet"). The combination of distribution of weight pressure and directionally stabilizing fluid circulation also supports a functionally correct take-off; a factor crucial for walking or running in a physiologically correct manner.

Finally, with the forefoot pads or cushions of the invention, the insole combines the above distinguishable advantages of anatomical fluid flow with pain relief within localized areas of the forefoot region. Most forefoot problems can be treated with some kind of simple orthotic support, such as cushions, pads or air cell neoprene devices. For localized areas, treatment can be performed with a pad placed just proximal to and around the painful area. For example, a pad placed just proximal to one of the metatarsal heads elevates the heads and will result mechanically in decreased extension of the corresponding metatarsophalangeal joints.

While the preferred embodiment of the present invention has been shown and described, it is to be understood that various modifications and changes could be made thereto without departing from the scope of the appended claims.

What is claimed is:

1. An insole, comprising a substantially fluid tight bladder, said bladder comprising an upper layer and a lower layer sealing joined at their peripheral margins, said bladder having a generally foot shaped planar configuration with a proximal forefoot region, a hindfoot region and an midfoot region there between, a heavy liquid substantially filling said bladder;

at least two transversely spaced metatarsal pads between said upper and lower bladder layers in said proximal forefoot region of said bladder, said pads comprising a solid or semi-solid material; and at least one substantially longitudinal, forefoot flow passage between said pads in said proximal forefoot region, at least two substantially longitudinal forefoot flow passages between said pads and the medial margin of said proximal forefoot region of said bladder and between said pads and the lateral margin of said forefoot region of said bladder, said liquid being flowable through at least one of said forefoot flow passages in a longitudinal direction within the proximal forefoot region and from the proximal forefoot region into the midfoot region of said bladder.

2. An insole as in claim 1, further comprising a pair of flow restrictors in the distal end of the hindfoot region of said bladder, one of said restrictors adjacent the medial peripheral margin of said bladder and the other adjacent the lateral peripheral margin of said bladder, said pair of restrictors defining a longitudinal flow channel there between.

3. An improved insole as in claim 1, the wearer's foot having a lateral longitudinal arch and a medial longitudinal arch and a border there between, said insole further comprising an elongated flow controller bridging the forefoot and midfoot regions of said bladder, the elongation of said flow controller substantially matching the border between lateral and the medial longitudinal arch of the wearer's foot, said flow controller controlling liquid flow from said hindfoot region to said proximal forefoot region and vice versa and substantially defining a semi-enclosed volume in which accumulation of liquid occurs when liquid flows into the medial longitudinal arch region.

4. An improved insole as in claim 1, wherein said bladder comprises an upper layer and a lower layer joined at their peripheral margins, said bladder further comprising a layer of sweat absorbing material attached to and substantially covering at least one of said layers.

5. An improved insole as in claim 1, wherein said insole is incorporated into footwear.

6. An improved insole as in claim 1, further comprising at least one hindfoot flow deflector in the hindfoot region of said bladder and at least two longitudinal hindfoot flow passages between said hindfoot deflector(s) and the lateral and medial margins of said bladder, at least two of said hindfoot flow passages having substantially equal transverse dimension.

7. An improved insole as in claim 1, further comprising a pair of flow restrictors in the proximal end of the proximal forefoot region of said bladder, one said restrictors against the medial margin of said bladder and the other said restrictors against the lateral margin of said bladder, and at least one longitudinal flow channel between said restrictors.

8. An insole as in claim 1, said metatarsal pad comprising a solid or semi-solid material.

9. An insole as in claim 1, wherein said liquid is a sterile, heavy, viscous liquid.

* * * * *